US005503318A

United States Patent [19]

Chou

[11] Patent Number: 5,503,318

[45] Date of Patent: Apr. 2, 1996

[54] TICKET RELEASING APPARATUS

[76] Inventor: Long-Shou Chou, 1F., No. 5, Lane 1, Alley 138, Hsing-Yun Road, Nei-Hu, Taipei, Taiwan

[21] Appl. No.: 328,681

[22] Filed: Oct. 25, 1994

[51] Int. Cl.[6] ..... B65H 23/06

[52] U.S. Cl. ..... 226/144; 226/129; 226/188; 101/66

[58] Field of Search ..... 226/127, 129, 226/152, 195, 144, 145, 188, 187, 134, 191; 242/564.4, 565; 101/66

[56] References Cited

U.S. PATENT DOCUMENTS

| | | | |
|---|---|---|---|
| 4,202,468 | 5/1980 | Anderson et al. | 226/68 X |
| 4,272,001 | 6/1981 | Howniak | 226/187 |
| 5,113,758 | 5/1992 | Chou | 226/188 X |

*Primary Examiner*—John M. Jillions
*Assistant Examiner*—Thomas E. Dunn
*Attorney, Agent, or Firm*—Bacon & Thomas

[57] ABSTRACT

A ticket releasing apparatus comprising two spaced lateral boards, an upper and a lower guiding plates inclinedly disposed between the lateral boards, a roller and a driving pulley respectively disposed at recessed front ends of the guiding plates and frictionally engaged with each other, and a motor disposed under the driving pulley. The tickets are fed through a space between the guiding plates toward the roller and driving pulley. The motor drives a gear set to drive two driven gears and a brake ratchet which via a transmission sleeve makes the driving pulley rotate and frictionally drive the roller to rotate in a reverse direction so as to send out the ticket between the two guiding plates. By means of the engagement between the brake ratchet and the driven ratchet, a linkage connected with the driven ratchet is able to make a stopper plate disposed above the roller prevent the roller from rotating and thus prevent the ticket from being pulled outside by an unauthorized person. The upper guiding plate can be detached and the roller can be adjusted in height so as to facilitate replacement of the tickets and removal of jammed tickets as well as service of the apparatus.

4 Claims, 7 Drawing Sheets

TICKET RELEASING APPARATUS

BACKGROUND OF THE INVENTION

The present invention relates to a ticket releasing apparatus, and more particularly to a ticket releasing apparatus which effectively prevents the ticket from being pulled outside in a powered off state which indicates that a coin has not been inserted. In addition, the ticket releasing apparatus permits easy placement and replacement of the tickets, as well as easy removal of jammed tickets and quick service.

A conventional ticket vending machine is currently widely used in large sport fields, play gardens, etc. After a user inserts a coin into the ticket vending machine, a ticket releasing apparatus of the ticket vending machine will automatically release one or several tickets. In addition, in some play yards, a raffle ticket is released from a similar machine for exchanging for a prize. Such a machine also includes a ticket releasing apparatus as the ticket vending machine.

In the above ticket vending machine, a complicated mechanism is used to prevent the ticket from being pulled out by an unauthorized person who fails to insert a coin into the machine. The manufacturing and assembling procedures of such complicated mechanism are time-costing and troublesome. Moreover, with respect to the conventional ticket vending machine, the placement of the ticket roll and repair the machine cannot be easily and quickly performed. Therefore, an improved ticket releasing apparatus is necessary to eliminate the aforesaid shortcomings.

SUMMARY OF THE INVENTION

It is therefore a primary object of the present invention to provide a ticket releasing apparatus which effectively prevents the ticket from being pulled out and stolen by an unauthorized person when the apparatus is in a powered off state.

It is a further object of the present invention to provide the above ticket releasing apparatus in which an upper ticket guiding plate can be detached and a ticket sending roller can be raised so as to permit easy placement and replacement of the tickets as well as easy removal of jammed tickets and quick service.

According to the above objects, the ticket releasing apparatus of the present invention comprises two spaced lateral boards, upper and lower guiding plates inclinedly disposed between the lateral boards, a roller and a driving pulley respectively disposed at recessed front ends of the guiding plates and frictionally engaged with each other, and a motor disposed under the driving pulley. The tickets are fed through a space between the guiding plates toward the roller and driving pulley. The motor drives a gear set which meshes with a driving gear. Between the driving gear and the driving pulley are disposed a brake ratchet, a transmission sleeve, a spring and a driven ratchet. A linkage is pivotally connected with one side of the driven ratchet for driving a stopper plate located above the roller. When the motor is powered on, the gear set as well as the driving gear are rotated. By means of the engagement between the driving gear and the brake ratchet, the transmission sleeve is rotated to rotatably drive the driving pulley for sending out the ticket. In case an unauthorized person tries to steal the ticket, that is, to pull the ticket from the outside of the apparatus when the apparatus is in a powered off state, the brake ratchet will engage with the driven ratchet to make the stopper plate prevent the roller from rotating. Accordingly, the ticket is prevented from being pulled outside.

The present invention can be best understood through the following description and accompanying drawing, wherein:

DETAILED DESCRIPTION OF THE PREFERRED EMBODIMENT

Figure 1:
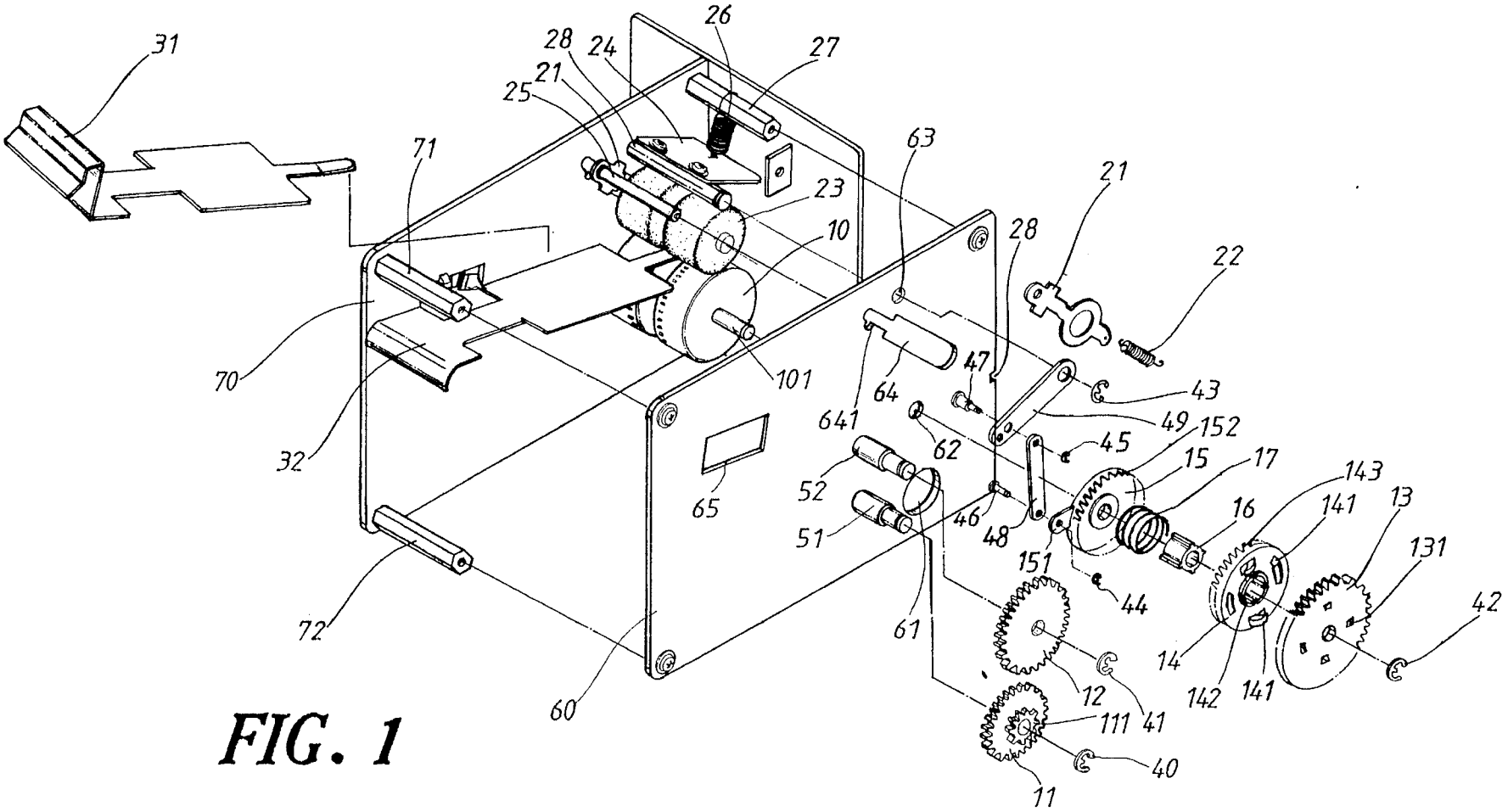
FIG. 1 is a perspective exploded view of the present invention.
Figure 2:
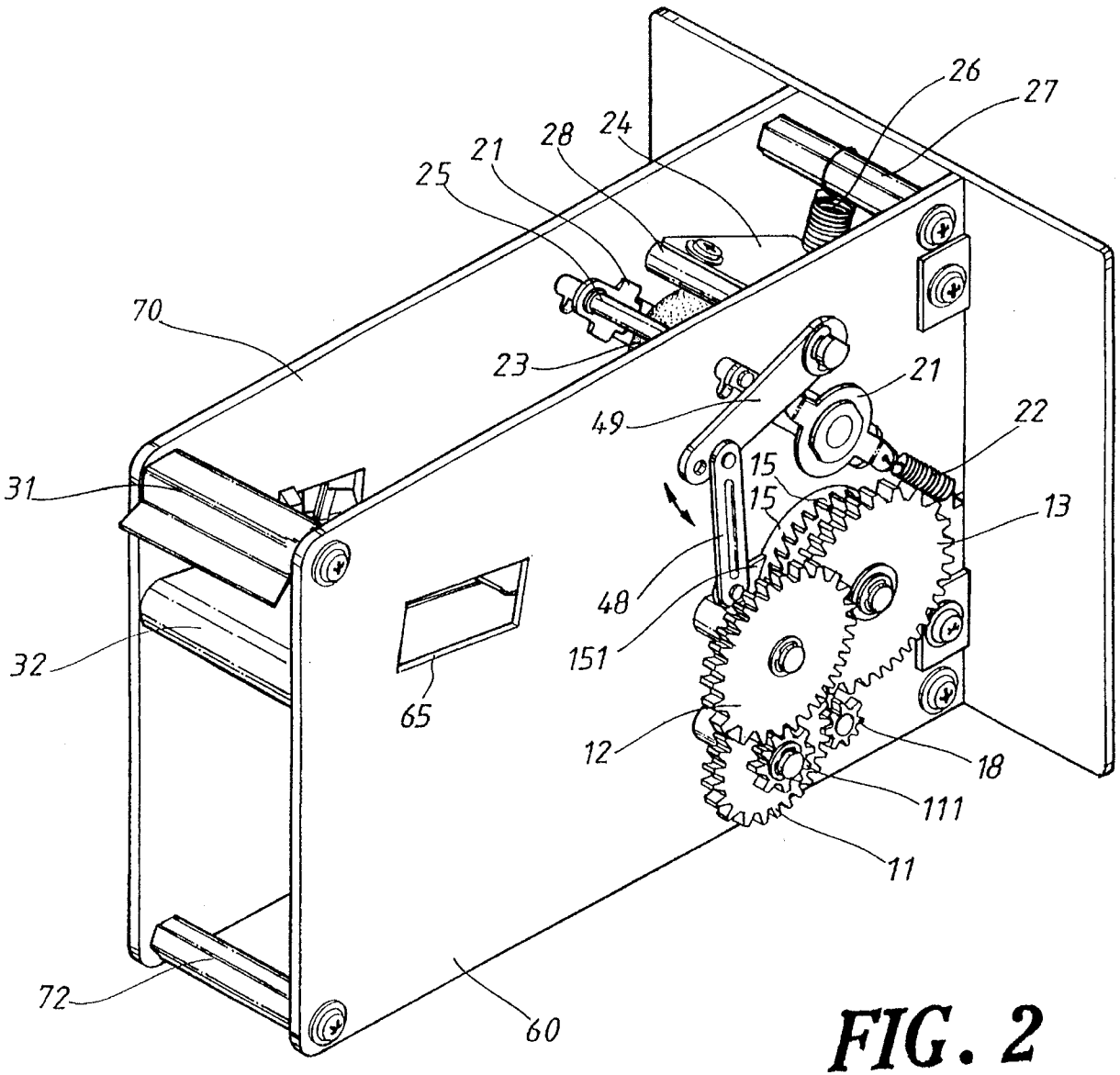
FIG. 2 is a perspective assembled view of the present invention.

Please refer to FIGS. 1 and 2. The ticket releasing apparatus of the present invention includes two lateral boards 60, 70, upper and lower guiding plates 31, 32 disposed between the lateral boards 60, 70, and a roller 23 and a driving pulley 10 respectively disposed at the from ends of the upper and lower guiding plates 31, 32 and frictionally engaged with each other. The tickets are fed through a space between the upper and lower guiding plates 31, 32 toward the roller 23 and the driving pulley 10. The driving pulley 10 has a central shaft 101 which passes through a shaft hole 62 of the lateral board 60 and protrudes outside the lateral board 60. On the central shaft 101 are fitted in sequence a driven ratchet 15, a spring 17, a transmission sleeve 16, a brake ratchet 14 and a driving gear 13. The driving gear 13 and gears 11, 12, 18 mesh with one another. The gear 18 is driven by a motor which serves as a power source. The driven ratchet 15 has a driving plate 151 projecting from one side of the driven ratchet 15 to connect in series with a transmission arm 48 and a force arm 49 to form a linkage. At one end of the force arm 49 opposite to the transmission arm 48 is pivotally connected a shaft rod 28. A stopper plate 24 is disposed on the shaft rod 28 by screws between the lateral boards 60, 70 above the roller 23. In addition, the two lateral boards 60, 70 are formed with roller slots 64, whereby the roller 23 is disposed between the two lateral boards 60, 70 by means of two roller seat plates 21, springs 22 and the shaft rod 28 and frictionally engaged with the driving pulley 10 at recessed neck portions of the upper and lower guiding plates 31, 32. A leaf spring seat 81 is disposed on the lateral board 70 at the front edges of the upper and lower guiding plates 31, 32, which clamp the ticket. The leaf spring seat 81 is used to clamp a row of tickets. The lateral board 60 is formed with lock ,holes 65 for installing a control circuit board 90 on the lateral board 60.

Figure 3:
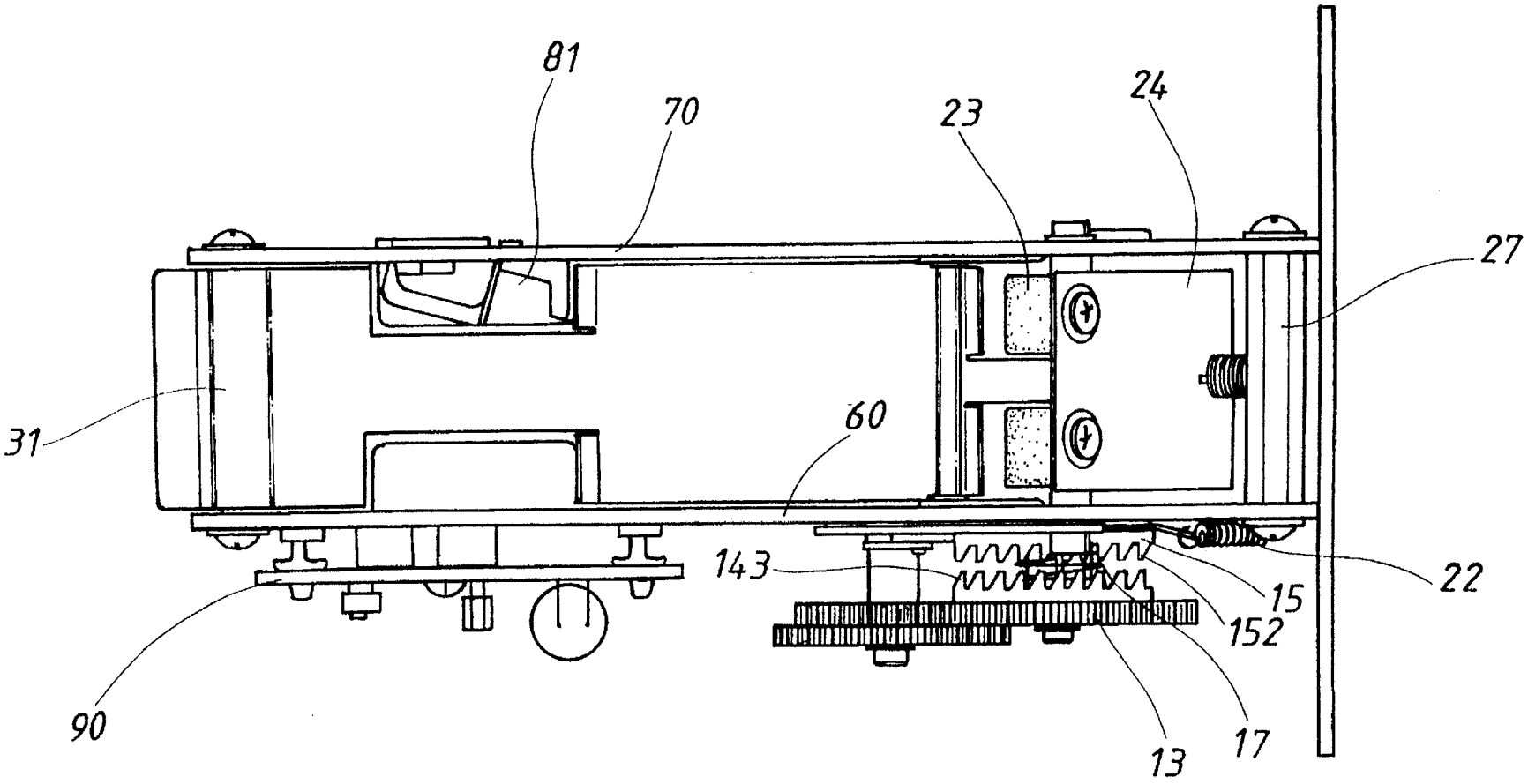
FIG. 3 shows the operation of the gears in a powered on state of the present invention.
Figure 5:
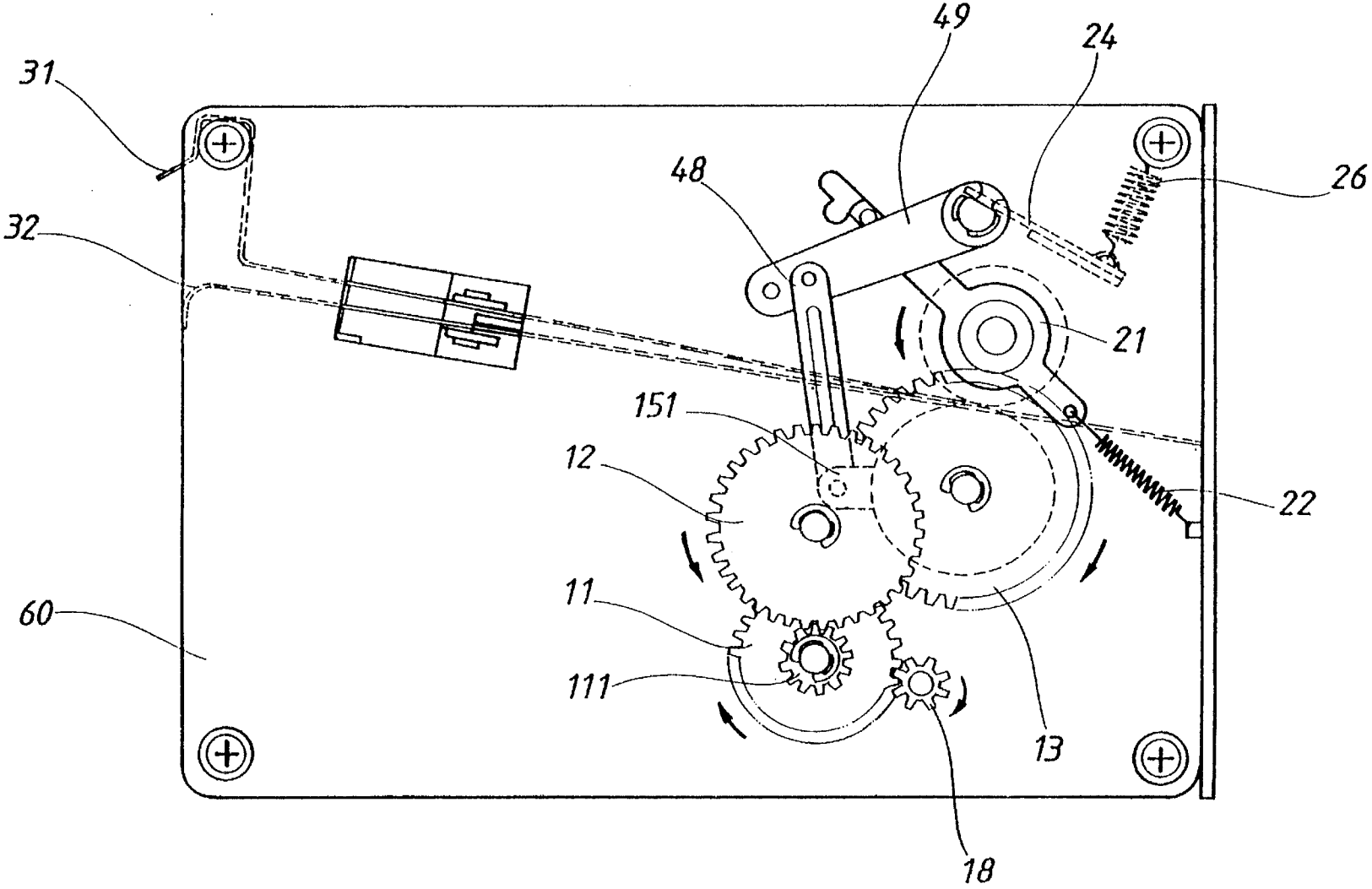
FIG. 5 shows the ticket releasing movement of the present invention.
Figure 6:
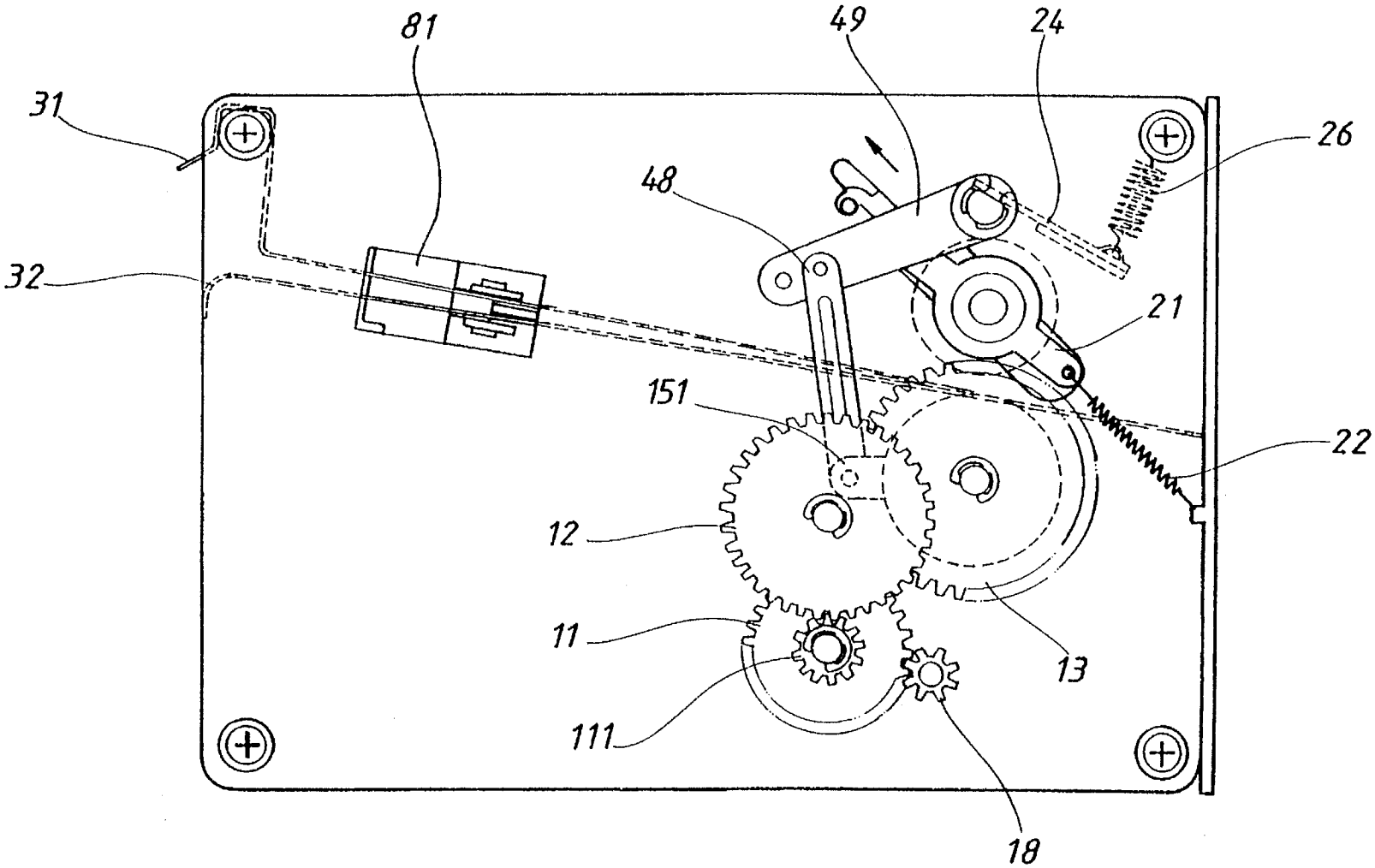
FIG. 6 shows that the roller is raised.

When the apparatus is powered on to send out the ticket, the gear 18 as well as the gears 11, 12 are rotated in the directions shown by the arrows of FIG. 5. Accordingly, the driving gear 13 is rotated clockwise. Meanwhile, by means of the engagement between the through holes 13 1 of the driving gear 13 and the bosses 141 of the brake ratchet 14 (referring to FIGS. 2 and 3), the brake ratchet 14 is also rotated clockwise. Four axial channels 142 disposed on inner periphery of the brake ratchet 14 in a cross pattern are engaged with four axial ribs of the transmission sleeve 16 so that the driving pulley 10 is rotated clockwise. Because the roller 23 and the driving pulley 10 are frictionally engaged with each other at the recessed neck portions of the upper and lower guiding plates 31, 32, the ticket is frictionally transferred out. At this time, the driven ratchet 15 is restricted by the spring 17 to separate, from the brake ratchet 14 without any action as shown in FIGS. 2 and 5.

Figure 4:
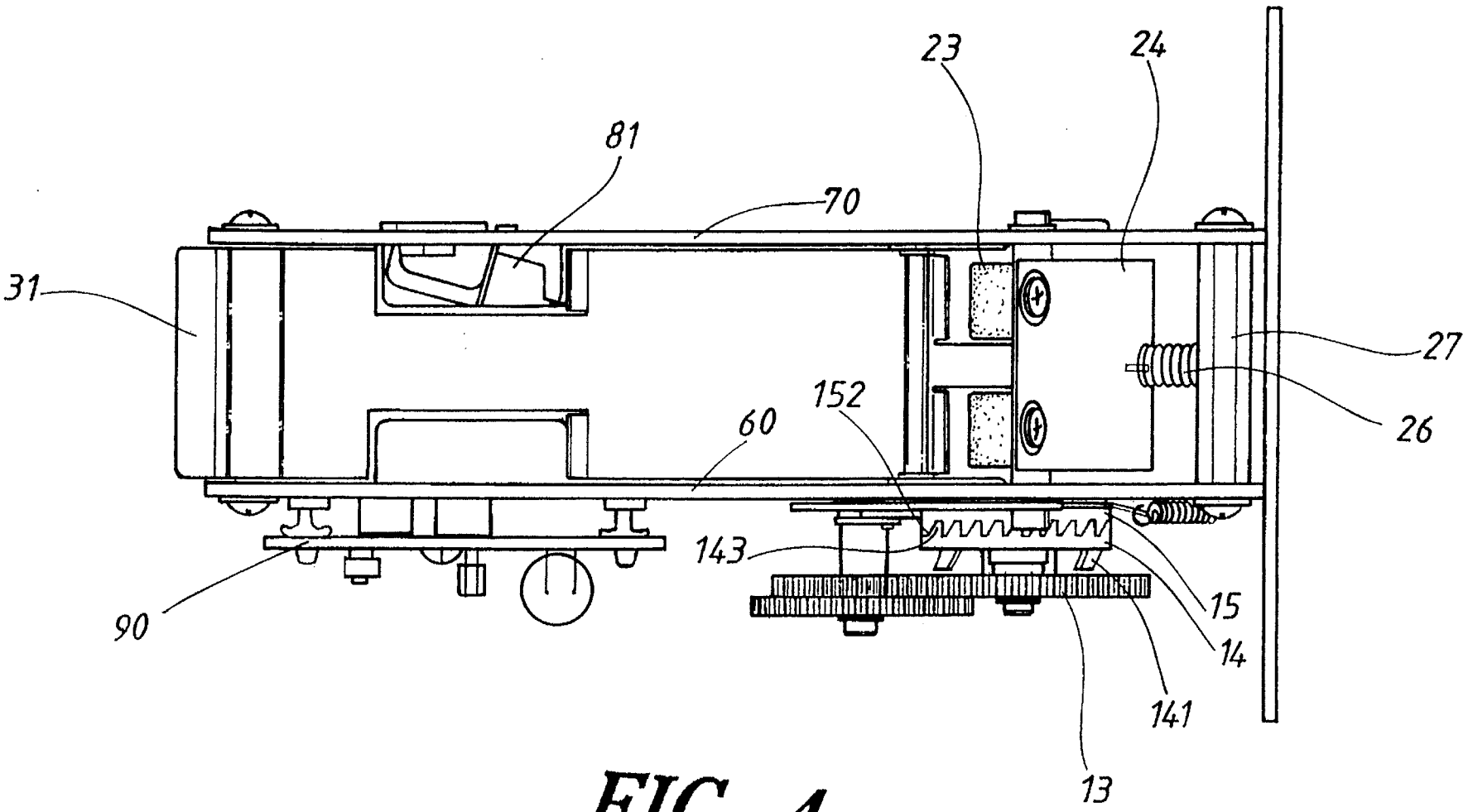
FIG. 4 shows that the ticket is pulled outward in a powered off state of the present invention.
Figure 7:
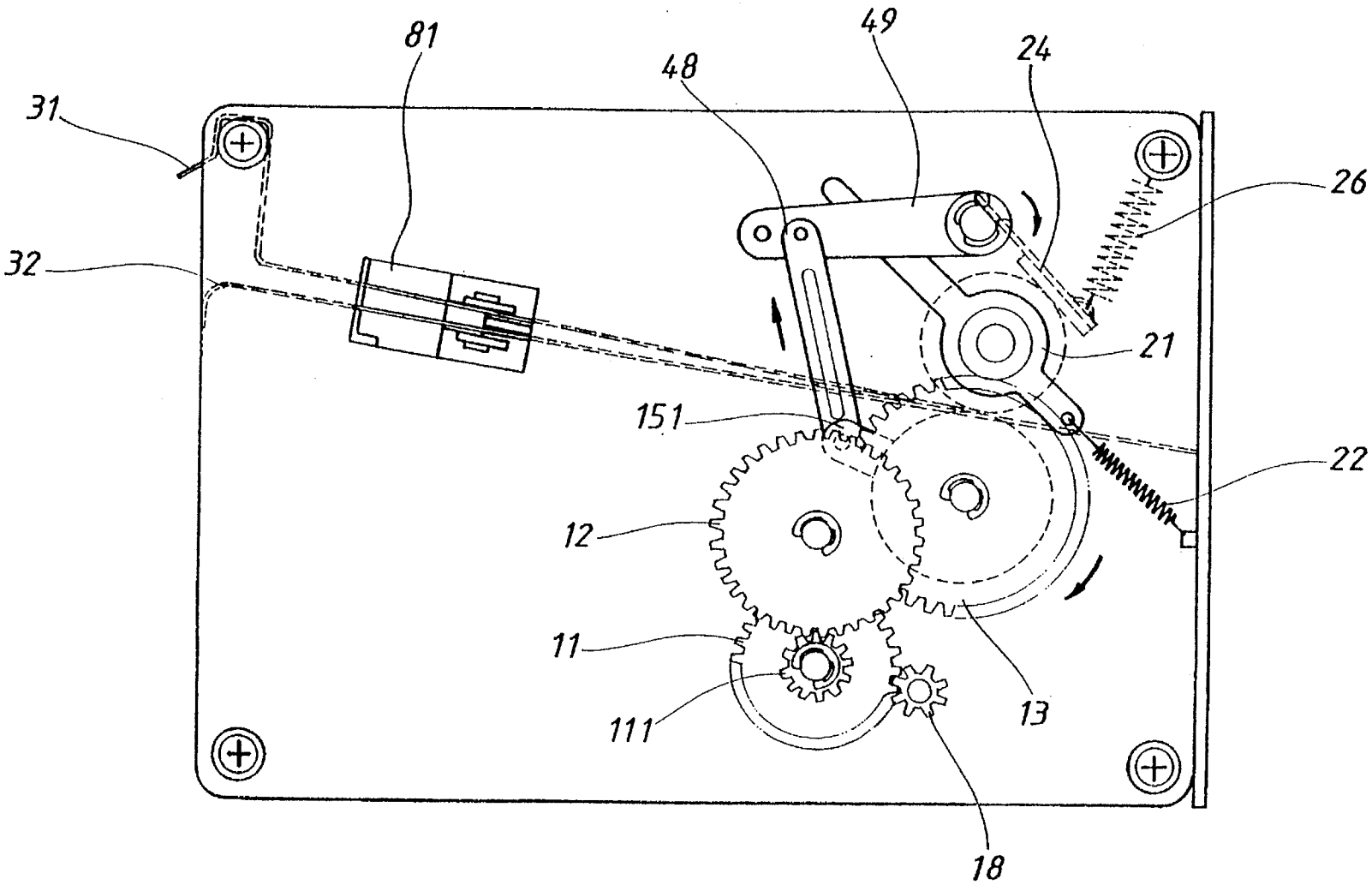
FIG. 7 shows the movement of the stopper plate of the present invention.

In case an unauthorized person tries to steal the ticket, that is, to pull the ticket from the outside when the apparatus is in a powered off state, the driving pulley 10 will be counterclockwise rotated while the gear 18 at the output shaft of the motor will not rotate and the gears 11, 12 and driving gear 13 are prevented from rotating. At this time, the bosses 141 of the brake ratchet 14, each of which has a single slope will push against the driving gear 13 and make the brake ratchet 14 separate therefrom. (This is because the bosses 141 will engage with the through holes 131 of the driving gear 13 only when rotated clockwise, while when rotated counterclockwise, the brake ratchet 14 is pushed away from the driving gear 13.) Moreover, by means of the engagement between the teeth 143 of the brake ratchet 14 and the teeth 152 of the driven ratchet 15 as shown in FIG. 4, the driving plate 151 of the driven ratchet 15 pulls the linkage formed by the transmission arm 48 and force arm 49 to make the shaft rod 28 rotate. Meanwhile, the stopper plate 24 of the shaft rod 28 prevents the roller 23 from rotating. Accordingly, the driving pulley 10, which frictionally engages with the roller 23 will not counterclockwise rotate. Therefore, by means of the frictional force exerted on the ticket by the driving pulley 10 and roller 23, the ticket is prevented from being pulled outside as shown in FIG. 7.

Furthermore, when replacing or placing the tickets, the upper guiding plate 31 can be drawn upward and the roller 23 can be raised by means of the roller slots 64 of the lateral boards 60, 70, roller seat plates 21, springs 22 and linkage shaft 25. The linkage shaft 25 can be engaged with an engaging notch 641 of the slat 64 and fixed therein as shown in FIG. 5. As a result, the installation and service of the apparatus are facilitated.

It is to be understood that the above description and drawings are only used for illustrating one embodiment of the present invention, and are not intended to limit the scope thereof. Any variation and derivation from the above description and drawings should be included in the scope of the present invention.

What is claimed is:

1. A ticket releasing apparatus for dispensing tickets, comprising two lateral boards spaced by a predetermined distance, two opposite guiding plates inclinedly disposed between said lateral boards, a roller and a driving pulley respectively disposed at recessed front ends of said guiding plates, the roller frictionally engaged with the driving pulley, and a motor disposed under said driving pulley, such that tickets are fed through a space between said opposite guiding plates toward said roller and driving pulley, whereby:

said driving pulley has a central shaft on which a driven ratchet, a spring, a transmission sleeve, a brake ratchet and a driving gear are fitted in sequence, said driven ratchet having multiple teeth and a driving plate projecting from one side of said driven ratchet to connect in series with a transmission arm and a force arm which form a first linkage, at one end of said force arm opposite to said transmission arm being pivotally connected a shaft rod to form a second linkage, a stopper plate being disposed on said shaft rod between said lateral boards for stopping said roller from rotating when the stopper plate is actuated;

said brake ratchet is coaxially engaged with said driving pulley via said transmission sleeve and has multiple teeth engaging with said driven ratchet on one side thereof, said brake ratchet being disposed with several bosses on one side opposite to said teeth, said bosses being engaged with said driving gear when rotated in a first direction so as to rotatably drive said driving pulley;

said driving ear meshes with a gear set which is connected with and driven by said motor and is formed with through holes corresponding to said bosses of said brake ratchet; and said roller is disposed between said two lateral boards by two roller seal plates, and said shaft rod.

2. A ticket releasing apparatus as claimed in claim 1, wherein said driving plate of said driven ratchet is pivotally connected with said first linkage formed by said transmission arm and force arm.

3. A ticket releasing apparatus as claimed in claim 1, wherein one of said guiding plates is detachable.

4. A ticket releasing apparatus as claimed in claim 1, wherein said roller is adjustable in height via said first and second linkages and said roller seal plates.

* * * * *